US010604903B2

(12) United States Patent
Kasim et al.

(10) Patent No.: US 10,604,903 B2
(45) Date of Patent: Mar. 31, 2020

(54) ROTARY BROOM WITH SNOW AND ICE REMOVAL SYSTEM

(71) Applicant: Alamo Group Inc., Seguin, TX (US)

(72) Inventors: Rikos A. Kasim, Mukwonago, WI (US); Ted N. Tadysak, Germantown, WI (US)

(73) Assignee: Alamo Group Inc., Seguin, TX (US)

( * ) Notice: Subject to any disclaimer, the term of this patent is extended or adjusted under 35 U.S.C. 154(b) by 106 days.

(21) Appl. No.: 15/996,911

(22) Filed: Jun. 4, 2018

(65) Prior Publication Data

US 2019/0368145 A1 Dec. 5, 2019

(51) Int. Cl.
*E01H 5/09* (2006.01)

(52) U.S. Cl.
CPC ..... *E01H 5/092* (2013.01); *E01H 5/098* (2013.01)

(58) Field of Classification Search
CPC ..... E01H 5/092; E01H 5/098
USPC ..... 15/82
See application file for complete search history.

(56) References Cited

U.S. PATENT DOCUMENTS

| | | | | |
|---|---|---|---|---|
| 3,230,645 | A * | 1/1966 | Lutz | E01H 5/06 37/242 |
| 3,886,675 | A * | 6/1975 | Maisonneuve | E01H 8/06 37/211 |
| 5,742,967 | A * | 4/1998 | Giessler | E01H 1/042 15/340.3 |
| 6,035,478 | A * | 3/2000 | Miller | A46B 13/02 15/82 |
| 6,311,355 | B1 * | 11/2001 | Ruuska | E01H 1/056 15/78 |
| 7,650,660 | B1 | 1/2010 | Duncan, Sr. | |
| 7,921,502 | B1 | 4/2011 | Valverde | |
| 7,984,573 | B2 * | 7/2011 | Lau | A01B 45/00 37/242 |
| 9,777,450 | B2 * | 10/2017 | Katahira | E01H 8/06 |
| 10,260,209 | B1 * | 4/2019 | Malkov | E01H 5/104 |
| 2002/0152573 | A1 | 10/2002 | Tsukui et al. | |
| 2008/0184506 | A1 | 8/2008 | Dix et al. | |
| 2011/0099858 | A1 | 5/2011 | Jakus et al. | |

(Continued)

FOREIGN PATENT DOCUMENTS

| | | | | |
|---|---|---|---|---|
| CA | 2192413 | A1 * | 6/1998 | E01H 1/0818 |
| EP | 0296563 | A1 * | 12/1988 | E01H 5/08 |
| WO | WO-02070329 | A1 * | 9/2002 | B62D 55/10 |

*Primary Examiner* — Marc Carlson
(74) *Attorney, Agent, or Firm* — Andrus Intellectual Property Law, LLP

(57) ABSTRACT

A rotary broom assembly is provided for use with a vehicle to reduce the accumulation of ice and snow on the rotary broom assembly when clearing paved surfaces, such as airport runways. The rotary broom assembly includes one or more wiper assemblies that are mounted for reciprocating movement along a broom hood. The broom hood includes a generally flat top surface and the wiper assemblies move along the top surface to clear snow and ice from the top surface of the broom hood. During forward movement of the wiper blade, the scraping edge of the wiper blade contacts the top surface of the broom hood to remove accumulated ice and snow. During the reverse movement of the wiper blade, the scraping edge of the wiper blade is lifted from the top surface to reduce removal of accumulated ice and snow during the reverse movement.

19 Claims, 7 Drawing Sheets

(56) References Cited

U.S. PATENT DOCUMENTS

| | | | | |
|---|---|---|---|---|
| 2014/0196238 | A1 | 7/2014 | Valverde et al. | |
| 2014/0259476 | A1* | 9/2014 | Amin | E01H 5/092 15/82 |
| 2015/0282250 | A1 | 10/2015 | Smith | |

* cited by examiner

ROTARY BROOM WITH SNOW AND ICE REMOVAL SYSTEM

BACKGROUND OF THE INVENTION

The present disclosure relates to a rotary broom assembly for use with a vehicle to clear ice and snow from a surface, such as an airport runway. More specifically, the present disclosure relates to a rotary broom assembly that includes a wiper assembly that is operable to reduce the accumulation of ice and snow on the rotary broom assembly during usage.

A rotary broom assembly is often used along with a relatively large vehicle to clean ice and snow off of paved surfaces, such as an airport runway. The rotary broom assembly includes a brush that includes a series of bristle filaments mounted to a cylindrical core such that the brush is rotatable about a horizontal axis. The rotating brush is supported in front of the vehicle and contacts the paved surface to remove ice and snow from the paved surface. Typically, the rotation of the cylindrical core is powered by a hydraulic or mechanical drive motor. The brush is supported on a structural frame mounted to the vehicle such that the rotating brush can be used to windrow snow, slush, water, ice and debris from the paved surface, resulting in clean pavement providing superior braking and traction for vehicles, such as airplanes.

The upper portion of the rotating brush is typically shrouded by a broom hood to control the swept material and add protection to surrounding elements. Typically, the broom hood conceals approximately 180° of the brush and is formed from various materials, such as steel, aluminum, plastic or other suitable material.

In the process of sweeping snow, slush and ice off of the paved surface, it is common for the material being removed to accumulate on the upper and lower surfaces of the broom hood, particularly during times when the accumulated material, such as snow, is falling. The accumulation of the material detracts from the performance of the rotary broom in several different ways.

For example, the accumulation of the ice and snow on the top portion of the broom hood increases the weight of the entire assembly, which creates increased stress on the complete assembly, including the frame, hitch mechanism, supporting caster wheels and the vehicle. In addition, the accumulation of the material on top of the broom hood can limit the visibility in front of the vehicle. Further, the accumulation of the material on the broom hood increases the amount of power it takes to rotate the brush, since the bristles of the brush contact the accumulated snow as well as the paved surface being cleaned.

In addition to reducing the effectiveness of the actual rotary broom assembly, the accumulated material on the broom hood is detrimental to the sweeping process, since the accumulated material will occasionally release and drop behind the rotary broom and onto the cleaned pavement. In many situations, the vehicle including the front mounted rotary broom is the last piece of equipment to clean the runway and the chunks of ice and snow falling from the broom hood are left on the runway. Thus, another pass must be made to remove this material from the pavement to provide the clean surface desired.

To address the problems created by the accumulation of material on the broom assembly, and specifically the broom hood, the vehicle operator was required to remove the accumulation using a manual device, such as a shovel, push broom or other device. Alternatively, the broom hood could be designed having a unique shape having a steep angle to deter the material from accumulating to the broom hood in the first place. However, this steep, sloped shape increased the size of the overall assembly and proved to be unacceptable.

Therefore, a need exists for a rotary broom assembly that includes the ability to reduce or eliminate the accumulation of material on the broom assembly while not detracting from the overall operation of the broom assembly. Further, a need exists for a rotary broom assembly that operates to reduce the amount of accumulated material while not detracting from the operation of the rotary broom assembly.

SUMMARY OF THE INVENTION

The present disclosure relates to a rotary broom assembly that can be used with a vehicle for cleaning an accumulated material, such as snow, ice, slush or debris, from a paved surface, such as an airport runway.

A rotary broom assembly is shown and described for use with a vehicle and is operable to remove an accumulated material, such as ice or snow, from a surface, such as an airport runway. The broom assembly includes a rotating brush that has a generally circular cross section defined by an outer circumference. The brush is supported by a frame and rotates about a generally horizontal rotation axis during use. The rotation of the rotary brush removes ice and snow from the surface being treated. The rotary broom assembly further includes a broom hood that is spaced from the rotating brush. The broom hood extends along a length of the brush and is used to direct the movement of the removed ice and snow. In one embodiment of the disclosure, the broom hood includes a generally flat top surface along at least a portion of the broom hood. The rotary broom assembly further includes at least one wiper assembly that is operable to remove an accumulation of the ice and snow from the flat top surface of broom hood. The operation of the wiper assembly removes the accumulated ice and snow while assuring that the removed ice and snow is processed by the rotating brush and does not fall behind the broom assembly and onto the cleared runway during use.

The wiper assembly includes a wiper blade that is reciprocally movable in both a forward direction and a rearward direction. When the wiper blade is moving in a forward direction, a scraping edge of the wiper blade contacts the flat top surface of the broom hood to push the accumulated ice and snow forward where it can be acted upon by the rotating brush. When the wiper blade is moved in a rearward direction, the scraping edge of the wiper blade is elevated above the top surface of the broom hood to prevent accumulated ice and snow from being pulled off the rearward end of the broom hood and onto the cleared pavement.

In one embodiment of the disclosure, the wiper blade is driven by a drive cylinder and a link arm assembly that is positioned between the drive cylinder and the wiper blade. The link arm assembly includes a drive cylinder having a piston rod that is extendable and retractable from within a cylinder body. The link arm assembly includes link arms that rotate to transfer the linear movement of the drive cylinder into linear movement of the wiper blade.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
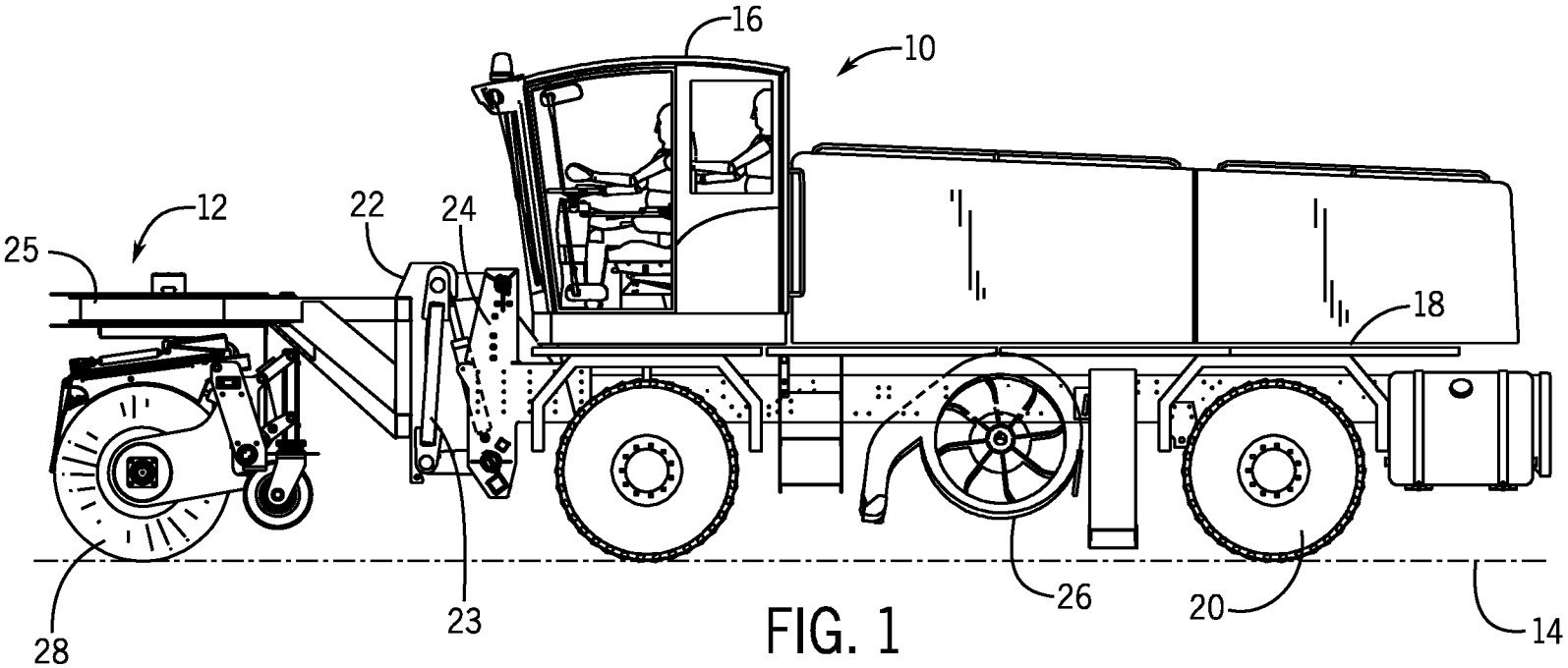
FIG. 1 is a side view of a vehicle that includes a rotary broom assembly used to clear an accumulated material, such as ice and snow, from a runway.

FIG. 1 illustrates a carrier or tow vehicle 10 that includes a rotary broom assembly 12 that is operable to remove accumulated material, such as snow, slush, water, ice or other debris from a paved surface 14. As illustrated in FIG. 1, the vehicle 10 includes an enclosed cab 16 mounted to a vehicle frame 18 having a plurality of individual tires 20 for moving the vehicle along the paved surface 14. As illustrated in FIG. 1, the rotary broom assembly 12 includes a vehicle hitch 22 that mounts the rotary broom assembly 12 to a mounting frame 24 included on the front of the vehicle 10. The vehicle hitch 22 includes lifting cylinders 23 that can be operated to control the contact between the rotary broom assembly 12 and the paved surface 14. The broom assembly includes a pivot assembly 25 that allows the angle of the rotary broom assembly 12 to be modified relative to the vehicle 10. In addition to the rotary broom assembly 12, the vehicle 10 can also include a blower assembly 26 that is operable to blow the accumulated material from the paved surface 14 following the removal of the material by the rotary broom assembly 12.

Figure 2:
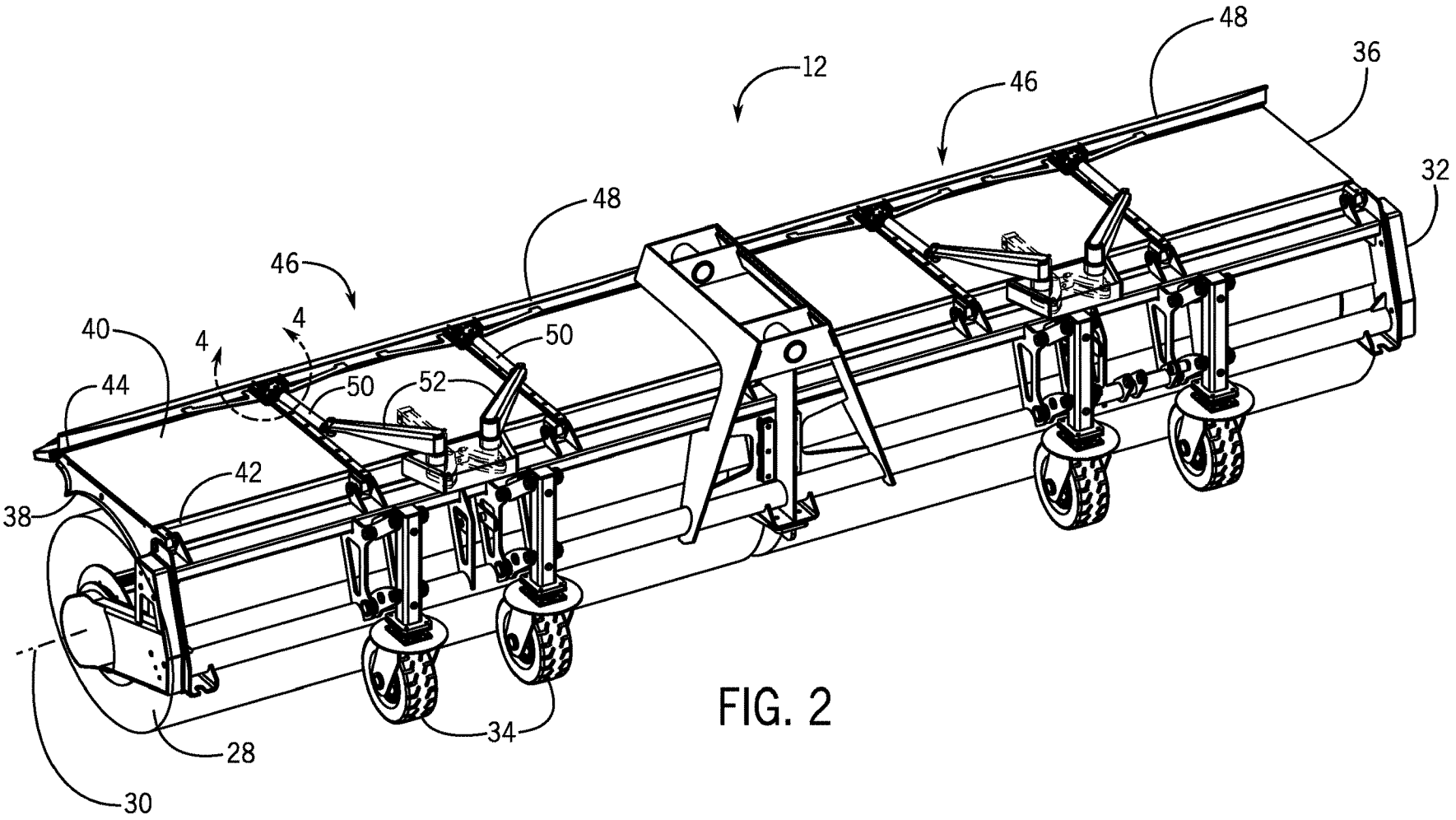
FIG. 2 is a perspective view of the rotary broom assembly used with the vehicle.

The rotary broom assembly 12 of the present disclosure is illustrated in FIG. 2. The rotary broom assembly 12 includes a brush 28 that contacts the paved surface during operation. In the embodiment illustrated, the brush 28 includes a plurality of individual bristles that are mounted to a center cylinder. The center cylinder, and thus the entire brush 28, is rotatable about a rotational axis 30 that is generally horizontal. The rotation of the brush 28 about the rotational axis 30 allows the brush 28 to clear debris from the paved surface while the vehicle is being moved at a relatively high speed. In the embodiment shown in FIG. 2, the diameter of the brush 28 can be either 48 inches or 52 inches, depending upon the manufacturer of the brush 28.

The brush 28 is rotatable about the axis 30 through a broom frame 32. The broom frame 32 extends along the width of the rotary broom assembly 12 and is supported for movement along the paved surface through a series of castor wheels 34. Each of the castor wheels 34 includes an adjustment mechanism that allows the castor wheels 34 to be extended or retracted to provide support for the entire rotary broom assembly 12 along the paved surface.

The rotary broom assembly 12 includes a broom hood 36 that covers and is spaced from at least an upper portion of the brush 28. In the embodiment shown in FIG. 2, the broom hood 36 has a curved inner surface 38 and a generally flat top surface 40. The generally flat top surface 40 extends from a trailing edge 42 to a leading edge 44. The leading edge 44 is positioned forward from the trailing edge 42 in the direction of vehicle movement.

In accordance with the present disclosure, the rotary broom assembly 12 is constructed including a pair of wiper assemblies 46 that are each operable to reduce the accumulation of snow and ice on the flat top surface 40 of the broom hood 36. During operation of the rotary broom assembly 12, the wiper assemblies 46 operate to push the accumulated snow and ice from the top surface 40 of the broom hood 36 past the leading edge 44 where the material fall toward the ground where the snow and ice then contact the rotating brush 28 and are removed form the paved surface. In the embodiment shown in FIG. 2, the rotary broom assembly 12 includes two separate wiper assemblies 46. However, it should be understood that in embodiments in which the rotary broom assembly 12 has a reduced width, the pair of wiper assemblies 46 could be replaced by a single wiper assembly.

Each of the wiper assemblies 46 generally includes a wiper blade 48 that is connected to a first end of one of a pair of drive rods 50. The drive rods 50, in turn, are each connected at an opposite, second end to one of a pair of link arms 52. The link arms 52 and drive rods 50 cause the wiper blade 48 to move in a reciprocating manner along the top surface 40 of the broom hood 36 in a manner to be described in greater detail below.

Figure 3:
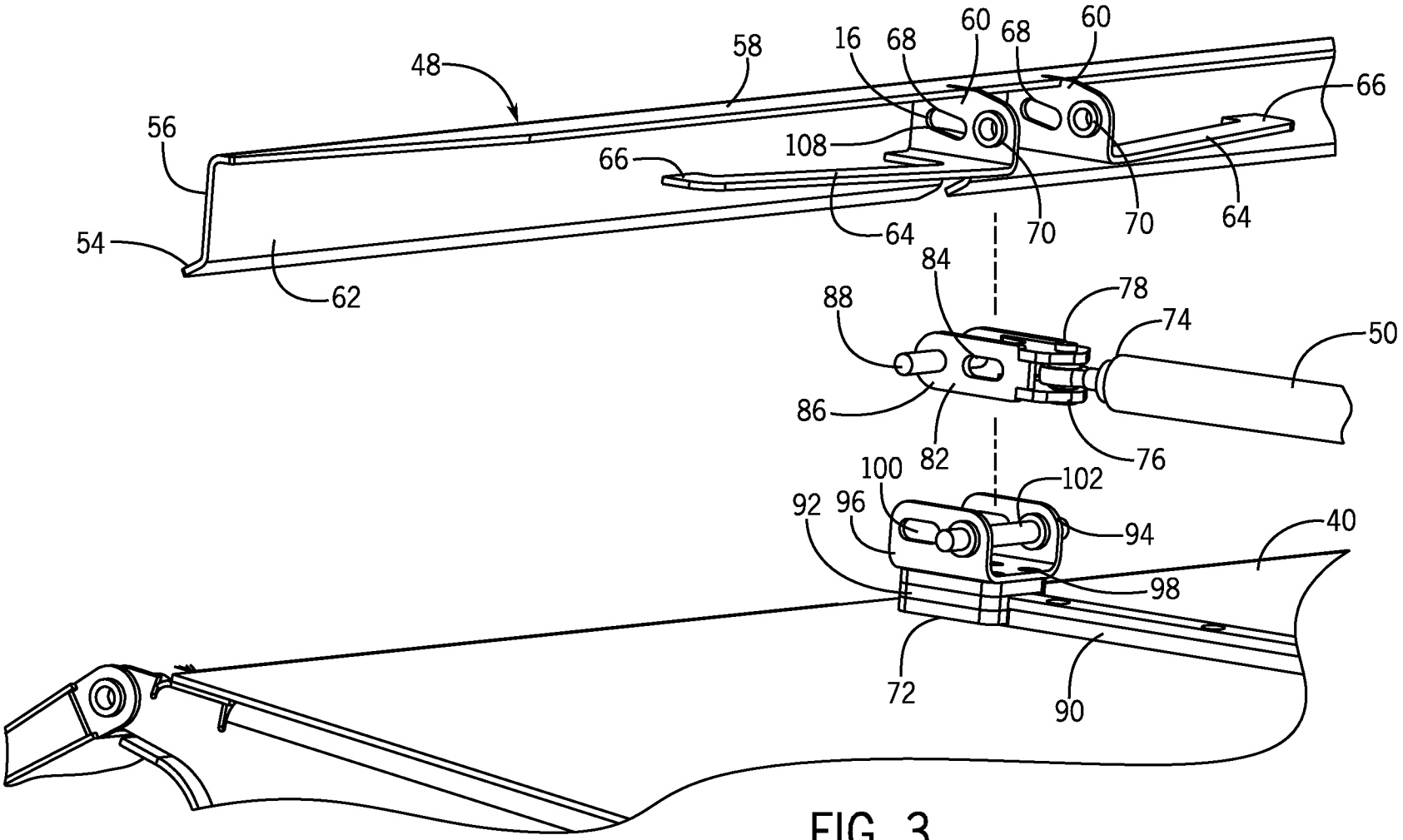
FIG. 3 is an exploded perspective view showing the mounting of a wiper blade of the wiper assembly to a drive piston.

Referring now to FIG. 3, the interconnection between one of the drive rods 50 and the wiper blade 48 will be described. In the embodiment shown in FIG. 3, the wiper blade 48 is formed from a metallic material and includes an angled scraping edge 54 that extends downwardly and forwardly from the main body portion 56. A top flange 58 is formed on the upper portion of the main body 56. In the embodiment shown, the scraping edge 54, main body 56 and top flange 58 are formed from a single piece of metallic material. However, different configurations for the wiper blade 48 can be used while operating within the scope of the present disclosure. A pair of spaced mounting brackets 60 are attached to the rear surface 62 of the main body 56. The mounting brackets 60 each include a support arm 64 that are each connected to the rear surface 62 of the wiper blade at an outer end 66. The vertical portion of the mounting bracket 60 includes both a driving slot 68 and a pivot hole 70.

Figure 4:
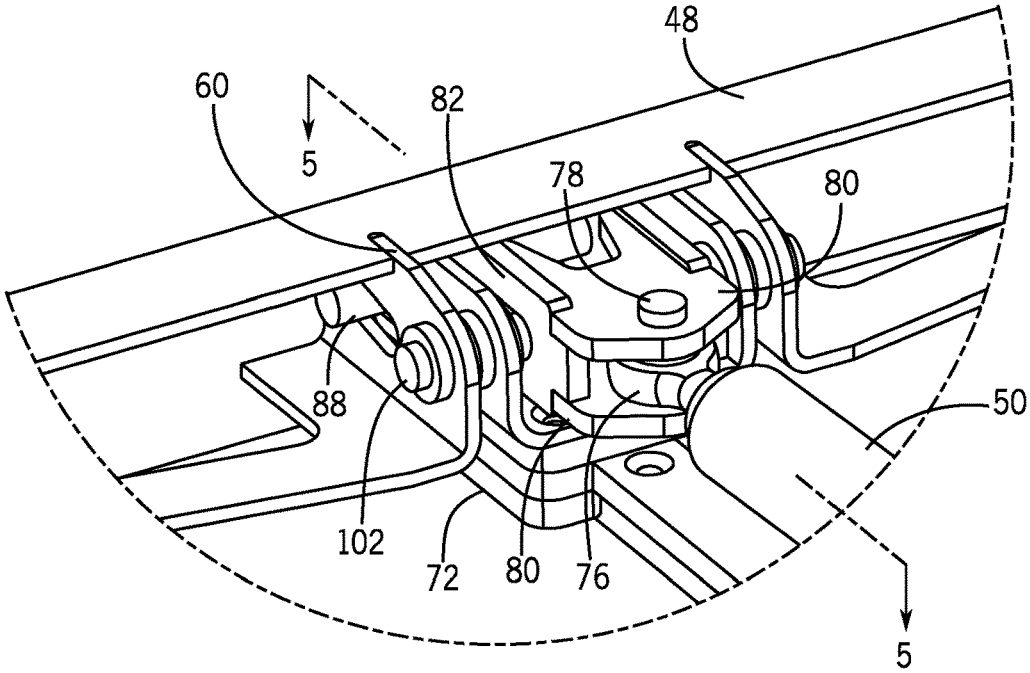
FIG. 4 is a magnified view of the mounting between the wiper blade and the drive piston.

The wiper blade 48 is connected to both the drive rod 50 and a slide block 72. The drive rod 50 includes an outer end 74 that includes an attachment portion 76. The attachment portion 76 includes an internal opening that receives a vertical clevis pin 78. The clevis pin 78 extends through the pair of spaced flanges 80 of a clevis bracket 82, as illustrated in FIGS. 3 and 4. The interaction between the clevis bracket 82 and attachment portion 76 through the clevis pin 78 allows for rotational movement between the drive rod 50 and the clevis bracket 82 while preventing separation during the extension and retraction of the wiper blade.

The clevis bracket 82 includes a pair of attachment slots 84 formed in each of a pair of spaced side flanges 86. Each of these side flanges 86 further includes an attachment pin 88.

Referring back again to FIG. 3, the side block 72 is designed for longitudinal movement along the length of a guide rail 90 mounted to the top surface 40 of the broom hood. The slide block 72 includes a base 92 having an open slot sized to receive the guide rail 90. The base 92 receives an attachment bracket 94 having a pair of side walls 96 extending perpendicular to a base plate 98. Each of the side walls 96 includes a guide slot 100. A connecting rod 102 extends between the pair of side walls 96.

Figure 5:
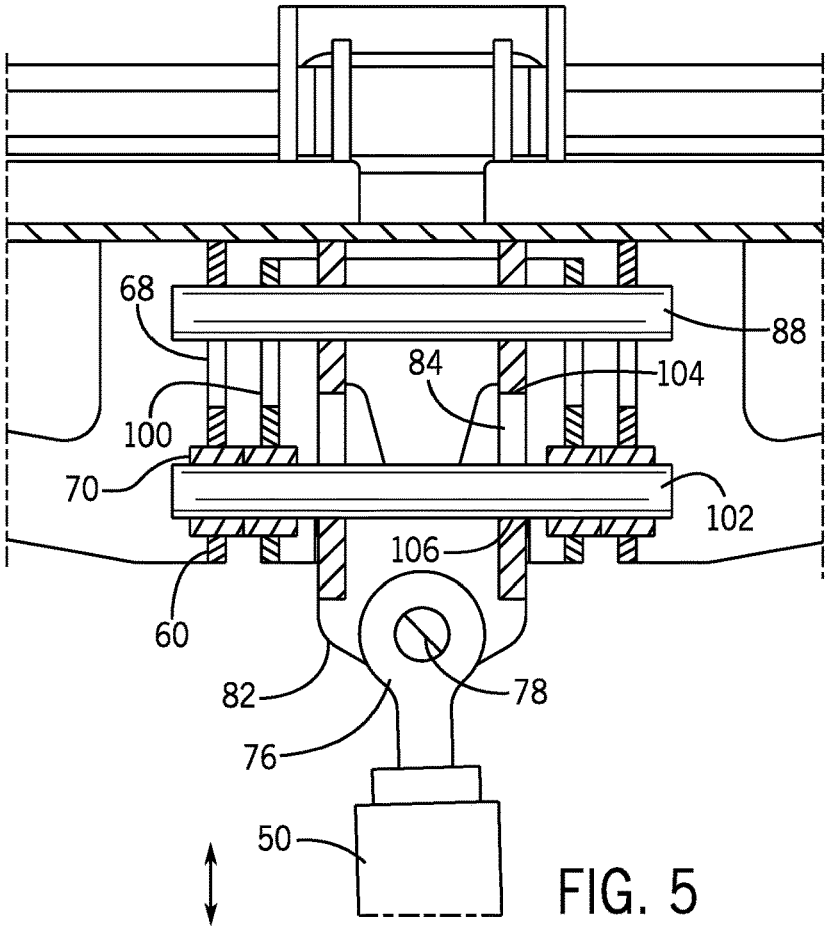
FIG. 5 is a section view taken along line 5-5 of FIG. 4.

FIGS. 4 and 5 illustrate the physical connections between the slide block 72, clevis bracket 82 and the mounting bracket 60. The interconnection between these components of the wiper assembly allows for the reciprocating movement of the wiper blade 48. As will be discussed below, during the forward movement of the wiper blade, the scraping edge travels along the top surface of the broom hood while movement of the wiper blade toward a retracted, rearward position lifts the scraping edge away from the top surface to prevent accumulated ice and snow from being pulled back toward the trailing edge of the top surface.

As illustrated in FIG. 5, the clevis pin 78 extends through the attachment portion 76 of the drive rod 50 and provides the primary connection between the drive rod 50 and the clevis bracket 82. The connecting rod 102 extends through the attachment slot 84 formed in the clevis bracket and is received within the pivot hole 70 formed in the side wall of the mounting bracket 60. Thus, as the drive rod 50 is extended and retracted, the connecting rod 102 is free to move within the attachment slot until the connecting rod 102 contacts either the leading edge 104 or trailing edge 106 of the attachment slot. During extension of the drive rod 50, the attachment portion 76 and interconnected clevis bracket 82 move forward until the trailing edge 106 of the attachment slot 84 contacts the connecting rod 102. Further forward movement causes the entire slide block 72 to move forward with the movement of the drive rod.

The clevis bracket 82 further includes the attachment pin 88 which is received in both the drive slot 68 of the mounting bracket 60 and the guide slot 100 of the slide block 72. As can be seen in FIG. 3, the guide slot 100 is horizontal while the driving slot 68 is angled upward from the rear end 108 to the front end 110. Thus, as the clevis bracket 82 moves forward, the guide slot 100 keeps the attachment pin 88 at a constant vertical position.

Figure 8:
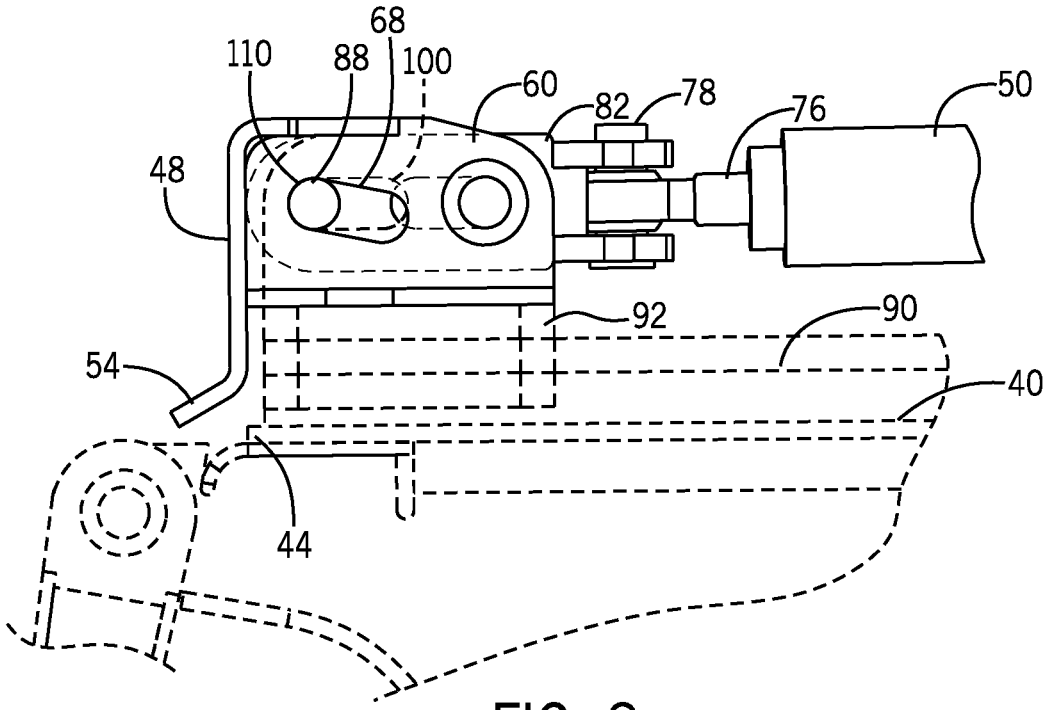
FIG. 8 is a side view taken along line 8-8 of FIG. 6.
Figure 9:
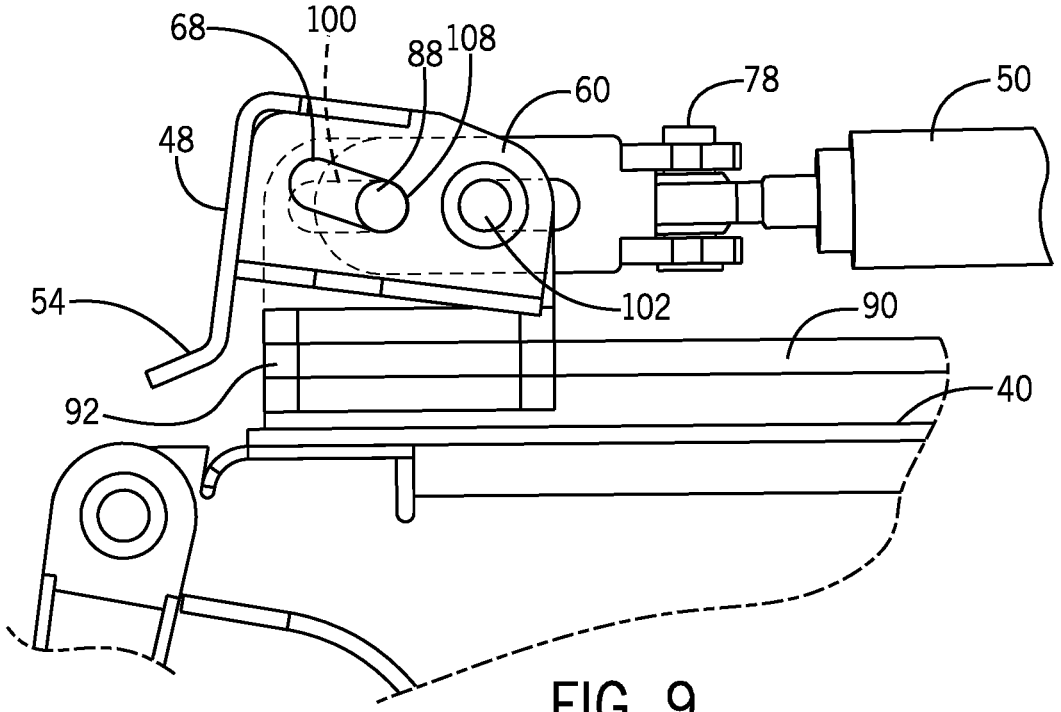
FIG. 9 is a side view taken along line 9-9 of FIG. 7.

FIGS. 8 and 9 illustrate the forward and rearward movement of the drive rods 50 and the effect on the scraping edge 54 of the wiper blade 48. As shown in FIG. 8, when the drive rod 50 moves forward, the attachment pin 88 moves forward in both the driving slot 68 of the mounting bracket 60 and the guide slot 100 of the clevis bracket 82. This movement continues until the attachment pin 88 contacts the front end 110 of the driving slot 68. In this position, the scraping edge 54 of the wiper blade 48 is in contact with the top surface 40 of the broom hood. Thus, the wiper blade 48 is able to push accumulated snow and ice past the leading edge 44 of the broom hood.

During the reciprocating movement of the wiper blade, the drive rod 50 is retracted as indicated in FIG. 9. During this retraction, the attachment pin 88 moves rearward. Once again, the horizontal orientation of the guide slot 100 prevents the attachment pin 88 from moving vertically. However, since the driving slot 68 is inclined, the rearward movement of the attachment pin 88 continued until the attachment pin 88 contacts the rear end 108. The movement of the attachment pin 88 within the driving slot 68 causes the entire mounting bracket 60 to pivot about the connecting rod 102, which elevates the scraping edge 54 as can be clearly seen in FIG. 9. Thus, as the wiper blade 48 is retracted, the scraping edge 54 is elevated from the top surface 40 to prevent the accumulated material from being dragged rearward with the wiper blade 48.

Figure 10:
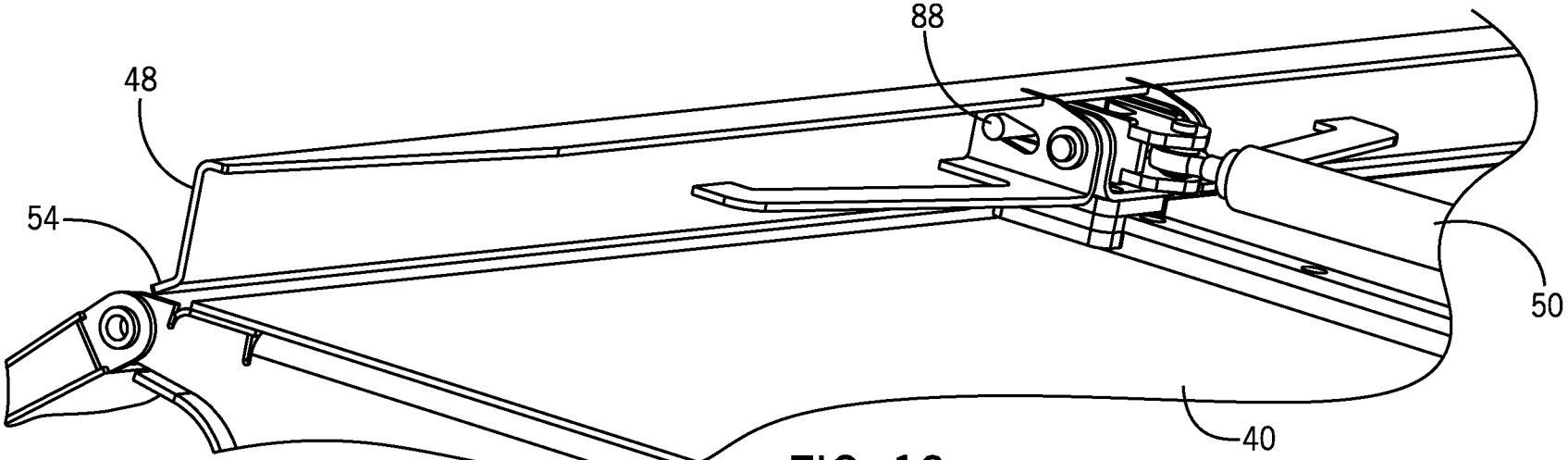
FIG. 10 is a perspective view showing the wiper blade in the down position.
Figure 11:
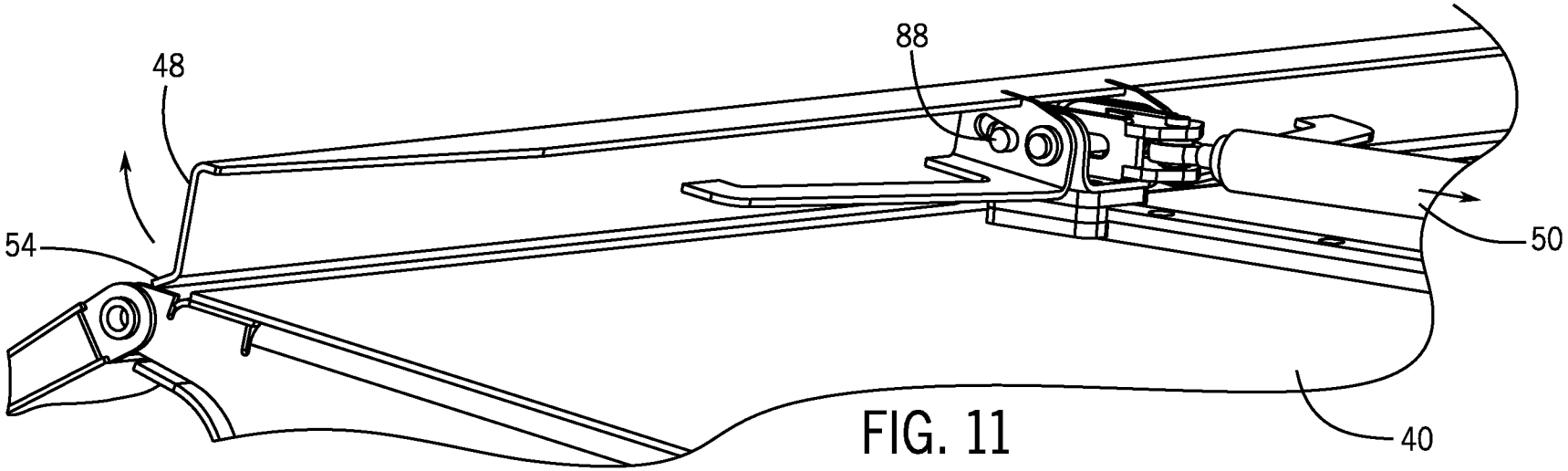
FIG. 11 is a perspective view showing the elevation of the wiper blade as the wiper blade is being retracted.

FIGS. 10 and 11 are views similar to FIGS. 8 and 9 showing the elevation of the scraping edge 54 of the wiper blade 48 during the rearward movement of the wiper blade along the top surface 40. As can be understood by these views, the elevation of the scraping edge 54 during the rearward movement and the downward pivoting of the scraping edge 54 into contact with the top surface 40 allow the wiper blade 48 to effectively operate in both the forward and rearward directions.

Figure 6:
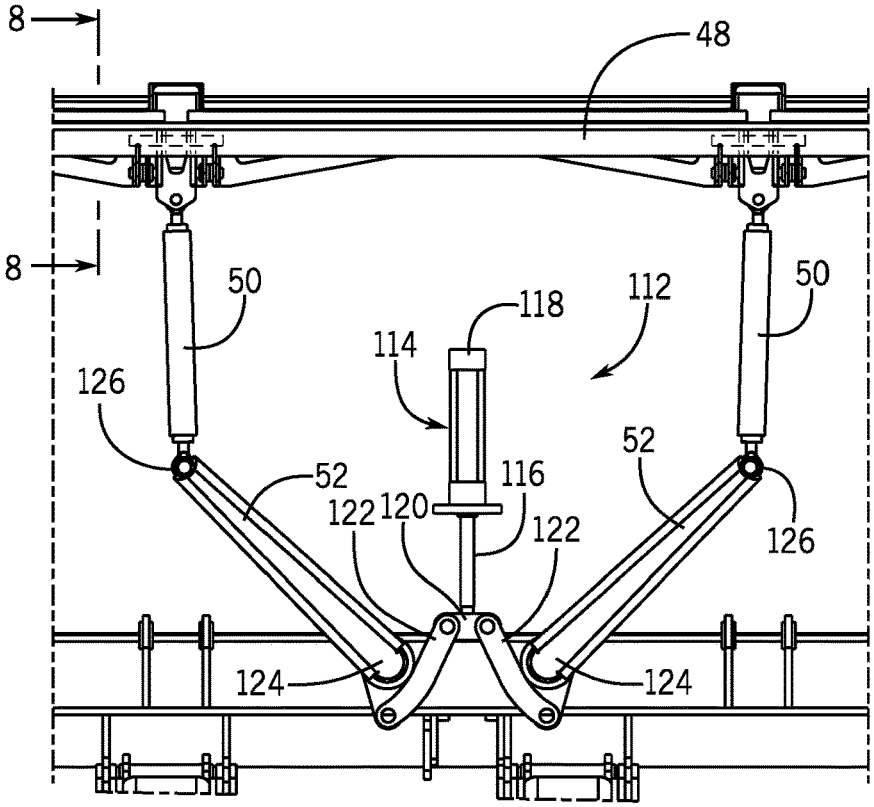
FIG. 6 is a top view showing the wiper in a fully extended position.
Figure 7:
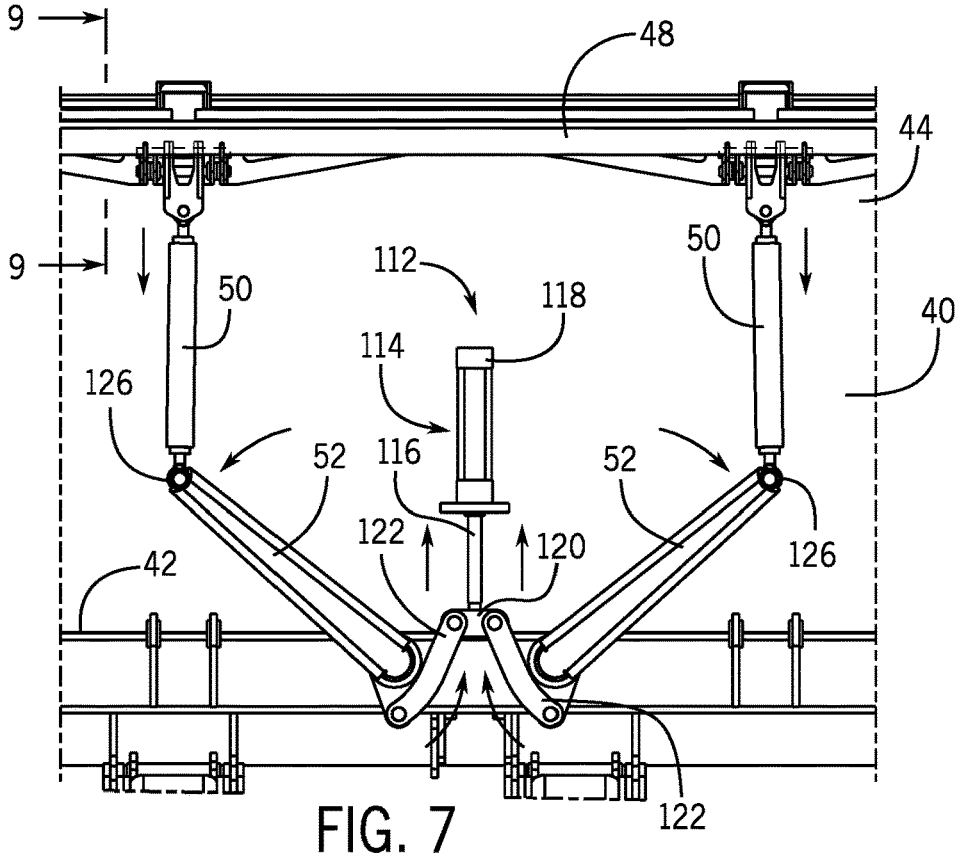
FIG. 7 is a top view showing the movement of the wiper blade toward a retracted position.

FIGS. 6 and 7 illustrate the drive assembly 112 used to move the wiper blade 48 in a reciprocating manner in both a forward and a rearward direction. The drive assembly 112 includes a drive cylinder 114 having a piston rod 116 that is moveable into and out of the cylinder body 118. The piston rod 116 is connected at an outer end to a drive block 120. The drive block 120 moves along with the piston rod 116 upon operation of the drive cylinder 114. The drive block 120 is connected to a pair of pivot brackets 122 connected to first ends 124 of the link arms 52. Each of the link arms 52 is pivotably mounted to the frame of the rotary broom assembly at the first end 124. In this manner, each of the link arms 52 rotates about the first end 124 during the extension and retraction of the piston rod 116. The second end 126 of each link arm 52 is connected to one of the two drive rods 50.

As can be seen in FIG. 7, when the piston rod 116 is retracted into the cylinder body 118, each of the link arms 52 rotates such that the second end 126 moves toward the trailing edge 42 of the top surface 40. This movement pulls each of the drive rods 50 toward the rearward end, which also results in the movement of the wiper blade 48 toward the trailing edge 42. As described previously, when the wiper blade 48 moves in the rearward direction, the scraping edge of the wiper blade is lifted to prevent the wiper blade 48 from pulling ice and snow toward the trailing edge 42.

Although not shown in FIGS. 6 and 7, when the piston rod 116 is extended, the movement of the drive block 120 causes the second ends 126 of the pair of link arms 52 to move toward the leading edge 44 of the top surface, which results in corresponding movement of the wiper blade 48 toward the leading edge 44. Thus, this reciprocating movement of the piston rod 116 into and out of the cylinder body 118 creates movement of the wiper blade in the opposite direction. Although one type of drive assembly 112 is shown in FIGS. 6 and 7, other types of drive assemblies are contemplated as being within the scope of the present disclosure.

As can be understood by the above description, the configuration of the wiper assembly allows the leading edge of the wiper assembly to push accumulated ice and snow forward and off of the broom hood, where the removed ice and snow can be acted upon by the rotating brush. When the wiper is retracted, the leading edge of the wiper is elevated from the top surface of the broom hood to prevent ice and snow from falling behind the rotating brush. In this manner, the wiper assembly can effectively remove accumulated ice and snow from the top surface of the broom hood during operation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A rotary broom assembly for use with a vehicle operable to remove an accumulated material from a surface, the rotary broom assembly comprising:

a rotary brush having a generally circular cross-section and an outer circumference, the brush being rotatable about a rotation axis;

a broom hood spaced from the brush and extending along a length of the brush; and a wiper assembly operable to remove an accumulation of the material from the broom hood.

2. The rotary broom assembly of claim 1 wherein the broom hood includes a generally flat top surface and the wiper assembly includes a wiper blade movable along a portion of the top surface.

3. The rotary broom assembly of claim 2 wherein the wiper blade is reciprocally movable in a forward direction and a rearward direction.

4. The rotary broom assembly of claim 3 wherein the wiper blade is in contact with the top surface when moving in the forward direction and is spaced from the top surface when moving in the rearward direction.

5. The rotary broom assembly of claim 3 wherein the wiper assembly comprises:

the wiper blade;

a drive cylinder;

a link arm assembly positioned to link the drive cylinder to the wiper blade, wherein retraction and extension of the drive cylinder moves the wiper blade in the forward and rearward directions.

6. The rotary broom assembly of claim 5 wherein the rotary broom assembly includes two wiper assemblies.

7. The rotary broom assembly of claim 5 wherein the wiper blade is connected to the link arm assembly by a mounting bracket and an attachment pin, wherein the attachment pin is movable within a driving slot formed in the mounting bracket.

8. The rotary broom assembly of claim 7 wherein the driving slot is angled relative to horizontal from a first end to a second end, wherein the attachment pin contacts the first end when the wiper blade is moving in the forward direction and the attachment pin contacts the second end when the wiper blade is moving in the rearward direction.

9. The rotary broom assembly of claim 5 wherein the link arm assembly includes a pair of pivoting link arms connected between the drive piston and the wiper to convert linear movement of the drive piston into linear movement of the wiper in an opposite direction.

10. The rotary broom assembly of claim 4 further comprising a guide rail mounted to the top surface of the brush, wherein the wiper moves along the guide rail.

11. A broom hood assembly for use with a rotary broom including a rotatable brush having an outer circumference, the broom hood assembly comprising:

a broom hood spaced from the brush and extending a length of the brush, the broom hood including a generally flat top surface; and a wiper assembly including a wiper blade movable along the top surface of the broom hood to reduce the accumulation of material on the top surface of the broom hood.

12. The broom hood assembly of claim 11 wherein the wiper blade is reciprocally movable in a forward direction and a rearward direction.

13. The broom hood assembly of claim 12 wherein the wiper blade is in contact with the top surface when moving in the forward direction and is spaced from the top surface when moving in the rearward direction.

14. The broom hood assembly of 11 wherein the wiper assembly comprises:

the wiper blade;

a drive cylinder;

a link arm assembly positioned to link the drive piston to the wiper, wherein retraction and extension of the drive cylinder moves the wiper blade in the forward and rearward directions.

15. The broom hood assembly of claim 14 wherein the rotary broom assembly includes two wiper assemblies.

16. The broom hood assembly of claim 14 wherein the wiper blade is connected to the link arm assembly by a mounting bracket and an attachment pin, wherein the attachment pin is movable within a driving slot formed in the mounting bracket.

17. The broom hood assembly of claim 16 wherein the driving slot is angled relative to horizontal from a first end to a second end, wherein the attachment pin contacts the first end when the wiper is moving in the forward direction and the attachment pin contacts the second end when the wiper is moving in the rearward direction.

18. The broom hood assembly of claim 14 wherein the link arm assembly includes a pair of pivoting link arms connected between the drive piston and the wiper to convert linear movement of the drive piston into linear movement of the wiper in an opposite direction.

19. The broom hood assembly of claim 13 further comprising a guide rail mounted to the top surface of the broom hood, wherein in the wiper moves along the guide rail.

* * * * *